US009048563B2

(12) United States Patent
Miura et al.

(10) Patent No.: US 9,048,563 B2
(45) Date of Patent: Jun. 2, 2015

(54) CONNECTOR FOR FLAT CABLES

(75) Inventors: Kazunori Miura, Makinohara (JP); Kouichi Ohyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 198 days.

(21) Appl. No.: 13/814,875

(22) PCT Filed: Aug. 12, 2011

(86) PCT No.: PCT/JP2011/068423

§ 371 (c)(1),
(2), (4) Date: Feb. 7, 2013

(87) PCT Pub. No.: WO2012/023506

PCT Pub. Date: Feb. 23, 2012

(65) Prior Publication Data

US 2013/0137285 A1 May 30, 2013

(30) Foreign Application Priority Data

Aug. 17, 2010 (JP) ..... 2010-182112

(51) Int. Cl.
*H01R 13/52* (2006.01)
*H01R 12/81* (2011.01)
*H01R 31/06* (2006.01)

(52) U.S. Cl.
CPC ..... *H01R 13/521* (2013.01); *H01R 12/81* (2013.01); *H01R 13/5205* (2013.01); *H01R 31/06* (2013.01)

(58) Field of Classification Search
USPC ..... 439/271, 492, 495, 586, 752, 357, 274
See application file for complete search history.

(56) References Cited

U.S. PATENT DOCUMENTS 6,146,190 A 11/2000 Fuerst et al.
6,582,242 B2 * 6/2003 Murakami et al. ..... 439/271

(Continued)

FOREIGN PATENT DOCUMENTS

JP 2-16586 U 2/1990
JP 3-46979 U 4/1991

(Continued)

OTHER PUBLICATIONS

Office Action, dated Apr. 2, 2014, issued by the Korean Patent Office in counterpart Korean application No. 10-2013-7006298 and Japanese translation.

(Continued)

*Primary Examiner* — Hae Moon Hyeon
(74) *Attorney, Agent, or Firm* — Sughrue Mion, PLLC

(57) ABSTRACT

This connector comprises: a connector housing (11), on one side of which is formed a flat cable terminal-section insertion section (13) wherein a flat cable terminal-section (26) is inserted, and on the other side of which is formed an interlocking hood section (15) wherein a mating connector (5) in an electric wire terminal (100) connected to a flat cable (2) interlocks; and a relay terminal (3) which is accommodated inside the connector housing (11), connects with a terminal fitting (7) in an electrical wire terminal, one end of which is connected to the flat cable terminal-section (26) and the other end of which is accommodated in the mating connector (5), and connects the flat cable (2) and electrical wire (6). A sealant accommodating section (17), wherein a sealant (9) which is attached to the flat cable terminal-section (26) is accommodated, is provided in the flat cable terminal-section insertion section (13).

6 Claims, 14 Drawing Sheets

(56) References Cited

U.S. PATENT DOCUMENTS

| | | | | |
|---|---|---|---|---|
| 6,786,768 | B2 * | 9/2004 | Murakami | 439/595 |
| 6,979,224 | B2 * | 12/2005 | Boemmel et al. | 439/492 |
| 7,534,139 | B2 * | 5/2009 | Andre et al. | 439/587 |
| 7,883,359 | B2 * | 2/2011 | Osaki et al. | 439/492 |
| 2002/0001987 | A1 * | 1/2002 | Murakami et al. | 439/271 |
| 2002/0137398 | A1 | 9/2002 | Miwa | |
| 2010/0279541 | A1 * | 11/2010 | Osaki et al. | 439/492 |

FOREIGN PATENT DOCUMENTS

| | | | |
|---|---|---|---|
| JP | 5-205830 | A | 8/1993 |
| JP | 6-5327 | A | 1/1994 |
| JP | 7-19955 | U | 4/1995 |
| JP | 7-220826 | A | 8/1995 |
| JP | 11-354222 | A | 12/1999 |
| JP | 2002-289287 | A | 10/2002 |
| JP | 2007-214087 | A | 8/2007 |
| JP | 2008-97992 | A | 4/2008 |
| JP | 2009-181933 | A | 8/2009 |
| WO | 2009/090998 | A1 | 7/2009 |

OTHER PUBLICATIONS

International Search Report for PCT/JP2011/068423 dated Oct. 4, 2011.

Communication dated Nov. 4, 2014, issued by the State Intellectual Property Office of the People's Republic of China in corresponding Chinese Application No. 201180039401.2.

Communication dated Oct. 7, 2014, issued by the Japan Patent Office in corresponding Japanese Application No. 2010-182112.

* cited by examiner

RELATED ART
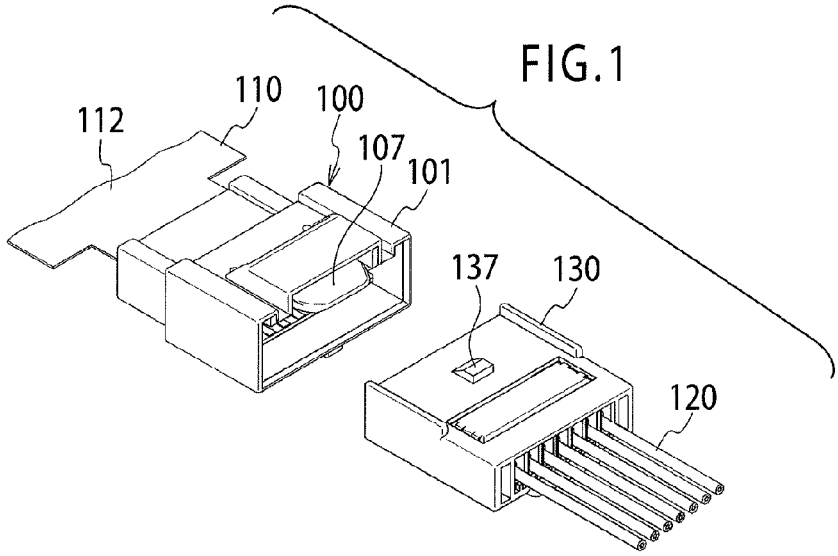
RELATED ART
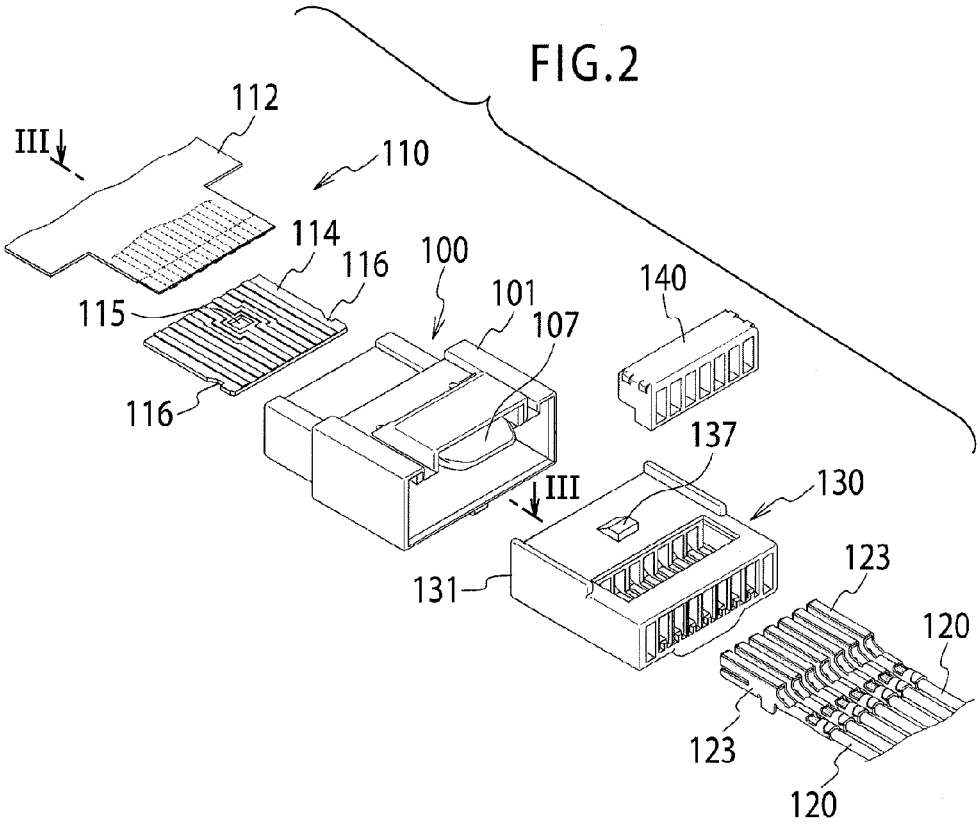

100

CONNECTOR FOR FLAT CABLES

TECHNICAL FIELD

The present invention relates to connectors for flat cables that are used to connect the flat cable of FPC (Flexible Printed Circuits), a FFC (Flexible Flat Cable), or the like to mating electric wires.

BACKGROUND ART

FIG. 1, FIG. 2, and FIG. 3 show a conventional connector for flat cables 100 described in Patent Literature 1.

The connector for flat cables 100, with a flat cable 110 such as a FPC or an FFC attached thereto, interlocks with a mating connector 130, to which an electric wire 120 is attached, thereby connecting the flat cable 110 to the electric wire 120.

As shown in FIG. 2 and FIG. 3, the flat cable 110 is formed of a body substrate 112 having a wiring pattern formed at a tip portion, and a connection substrate 114 in which a pattern connected to the wiring pattern of the body substrate 112 is formed and which is connected to the body substrate 112 via anisotropy conductive adhesive. The connection substrate 114 is to be inserted into and attached to the connector for flat cables 100, wherein a fixing hole 115 for positioning to the connector for flat cables 100 extends through a substantially center portion of the connection substrate 114 and a cut-off section 116 is formed on both sides thereof.

As shown in FIG. 3, the connector for flat cables 100 includes a housing 101, and in the housing 101 a substrate inserting section 103 for accommodating the connection substrate 114 is formed. Inside the housing 101, an engaging projection section 105 engaging with the fixing hole 115 of the connection substrate 114 is formed in the upper surface of an inner wall, and also a locking arm 106 engaging with the elastically deformable cut-off section 116 is formed on the both sides of the inner wall. Moreover, a lock section 107 for fixing the mating connector 130 is formed in the housing 101.

As shown in FIG. 2, the mating connector 130 includes a housing 131 inserted into the housing 101 of the connector for flat cables 100, and a terminal fitting 123 of the terminal of the electric wire 120 is inserted into the housing 131. Thus, the electric wire 120 is attached to the mating connector 130. Moreover, a lock projection 137 is formed in the housing 131. A retainer 140 is inserted into the housing 131, thereby guiding the terminal fitting 123 to a predetermined position of the housing 131.

In such a structure, the mating connector 130 is inserted from the tip side of the connector for flat cables 100 and interlocked with the connector for flat cables 100, and thereby the lock projection 137 is engaged with the lock section 107 of the connector for flat cables 100 to interconnect the mating connector 130 and the connector for flat cables 100. Due to this interconnection, the connection substrate 114 and the terminal fitting 123 are electrically conducted and connected.

CITATION LIST

Patent Literature

[PTL 1]
Japanese Patent Laid-Open No. 2007-214087

SUMMARY OF INVENTION

Technical Problem

However, the conventional connector for flat cables 100 does not have a waterproof function, and has a problem that it cannot be used for automobiles and outdoor equipments that are weathered.

Therefore, the present invention has an object to provide a connector for flat cables that has the waterproof function and thus can be used for the automobiles and outdoor equipments.

Solution to Problem

In order to achieve the above-described object, according to a first aspect of the present invention, a connector for flat cables includes: a connector housing, on one side of which is formed a flat cable terminal-section insertion section wherein a flat cable terminal section is inserted, and on the other side of which is formed an interlocking hood section wherein a mating connector of an electric wire terminal connected to a flat cable interlocks; and a relay terminal which is accommodated inside the connector housing, one end of which is connected to the flat cable terminal section, the other end of which is connected to a terminal fitting of an electric wire terminal accommodated in the mating connector, and connects the flat cable and electric wire. In this configuration, a sealant accommodating section, wherein a sealant which is attached to the flat cable terminal section is accommodated, is provided in the flat cable terminal-section insertion section.

According to a second aspect of the present invention depending from the first aspect, in the connector for flat cables, the flat cable terminal section includes a flat cable end and a slider which is attached to a tip side of the flat cable end and connects a flat cable to one end of the relay terminal; wherein the sealant is attached to the flat cable end; and wherein the slider is formed of a slider body covering one surface side of the flat cable end and a slider cover covering the other surface side of the flat cable end with the tip portion thereof being exposed.

According to a third aspect of the present invention depending from the first aspect or the second aspect, in the connector for flat cables, the relay terminal is formed of: a terminal body; a mating terminal connecting section which is provided on one side of this terminal body, provided in a protruding manner in the interlocking hood section in a state of being accommodated in the connector housing, and connects to a terminal fitting accommodated in the mating connector; and a flat cable terminal connecting section provided on the other side of the terminal body and connected to the flat cable terminal section.

According to a fourth aspect of the present invention depending from the third aspect, in the connector for flat cables, a locking dowel locking against an inner wall of a relay terminal accommodating section of the connector housing is formed on both sides of the terminal body; and wherein a spring terminal in contact with the flat cable end and a protection wall which is provided on both sides of this spring terminal, and protects the spring terminal, are formed in the flat cable terminal connecting section.

According to a fifth aspect of the present invention depending from any one of the first aspect to the fourth aspect, in the connector for flat cables, the sealant accommodating section, a relay terminal accommodating section, wherein a connection side of the flat cable end of the relay terminal is accommodated, and a slider accommodating section, wherein the slider of the flat cable terminal section is accommodated, are provided in the flat cable terminal-section insertion section; wherein in the connector housing, a relay terminal fixing section to which the relay terminal is fixed is provided between the flat cable terminal-section insertion section and the interlocking hood section; and wherein the relay terminal fixing section is a fixing insertion-hole that interlinks an interlocking hood section side and a flat cable terminal-section insertion section side.

According to a sixth aspect of the present invention depending from any one of the first aspect to the fifth aspect, in the connector for flat cables, the mating connector is formed of: a connector body with a terminal accommodating chamber, in which the terminal fitting connected to the other end of the relay terminal is accommodated, a mantle section which covers the connector body and into which the interlocking hood section of the connector housing is inserted; and a front holder preventing a terminal fitting, which is accommodated in the connector body and connected to the other end of the relay terminal, from slipping out of the terminal accommodating chamber, and wherein with the mating connector being interlocked with the interlocking hood section of the connector housing, a rubber gasket is arranged between a circumference surface of the connector body and the inner wall of the interlocking hood section.

Advantageous Effects of Invention

According to the invention described in the first aspect, the relay terminal connected to the flat cable terminal section is accommodated in the connector housing, and by interlocking the mating connector with the interlocking hood section of the connector housing, the relay terminal and the terminal fitting of the electric wire terminal accommodated in the mating connector are connected. Thus, the flat cable and the electric wire of the mating connector can be connected.

In the invention described in the first aspect, a sealant is attached to the flat cable terminal section, and because the sealant accommodating section for accommodating this sealant is formed in the flat cable terminal-section insertion section of the connector housing, the sealant is accommodated in the sealant accommodating section by inserting the flat cable terminal section into the flat cable terminal-section insertion section. Thus, the connector housing has a waterproof function and therefore the connector for flat cables that can be used for the automobiles and outdoor equipments can be obtained.

According to the invention described in the second aspect, the slider is attached to the flat cable end and with this slider the flat cable can be connected to the relay terminal. Therefore, the flat cable and the relay terminal can be reliably connected.

According to the invention described in the third aspect, the mating terminal connecting section is formed in the relay terminal, and with the relay terminal being accommodated in the connector housing, the mating terminal connecting section contacts the terminal fitting of the mating connector. Thus, the flat cable and the terminal fitting of the mating connector can be connected.

According to the invention described in the fourth aspect, because the locking dowel formed in the relay terminal is locked against the inner wall of the connector housing, the relay terminal can be reliably attached to the connector housing and also the relay terminal can be inserted into the connector housing via the locking dowel. Moreover, because the spring terminal of the relay terminal elastically contacts the flat cable end, the relay terminal and the flat cable can be reliably connected. Moreover, because the protection wall is formed on the both sides of the spring terminal, the spring terminal can be protected in inserting the relay terminal into the connector housing.

According to the invention described in the fifth aspect, the sealant accommodating section, the relay terminal accommodating section, and the slider accommodating section are formed in the flat cable terminal-section insertion section, and therefore the sealant, the relay terminal, and the slider of the flat cable can be reliably accommodated. Moreover, because the fixing insertion-hole for fixing the relay terminal is formed in the connector housing, the relay terminal can be easily accommodated in the connector housing.

According to the invention described in the sixth aspect, the mating connector and the connector for flat cables can be connected by interlocking the interlocking hood section with the mantle section of the mating connector. Moreover, because the front holder prevents the mating terminal from slipping out of the terminal accommodating chamber, the mating terminal can be reliably attached to the mating connector.

BRIEF DESCRIPTION OF THE DRAWINGS

FIG. 1 is a perspective view showing a conventional connector for flat cables and a mating connector.

FIG. 2 is an exploded perspective view showing the conventional connector for flat cables and the mating connector.

BEST MODES FOR CARRYING OUT THE INVENTION

Figure 3:
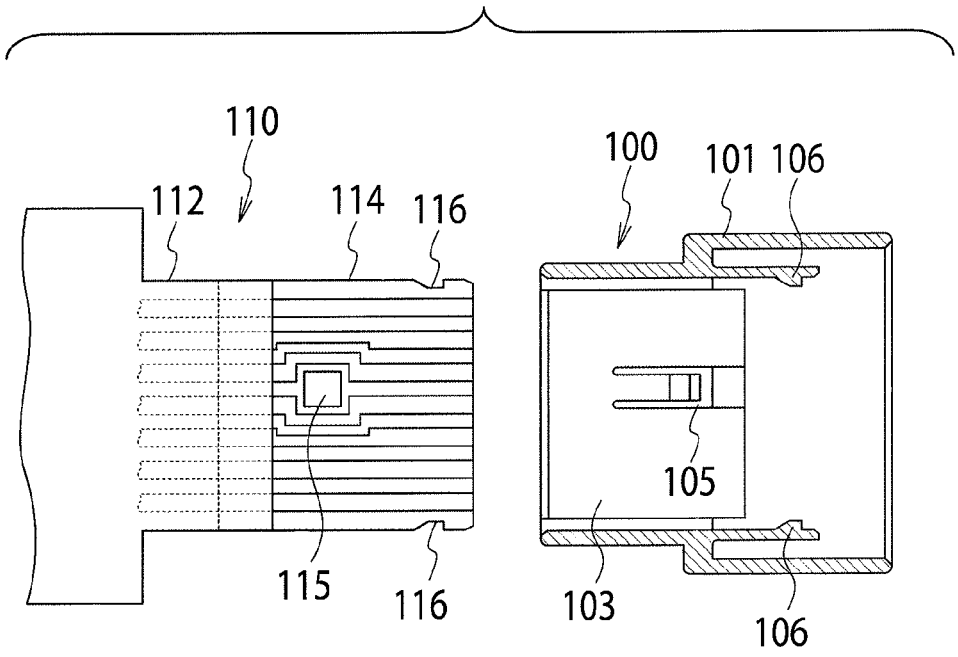
RELATED ART FIG.3
FIG. 3 is a cross sectional view along III-III line in FIG. 2.
Figure 4:
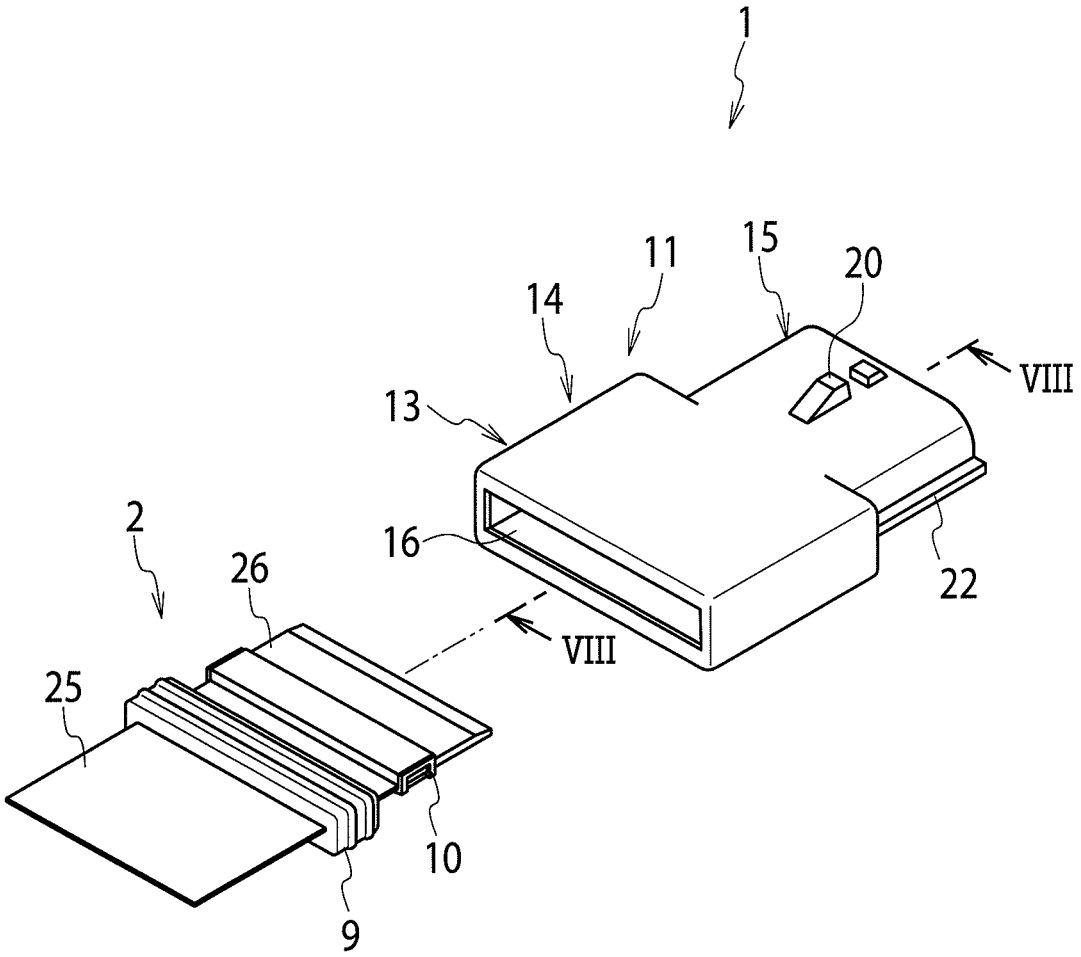
FIG. 4 is a perspective view showing a connector for flat cables of an embodiment of the present invention and a flat cable.
Figure 5:
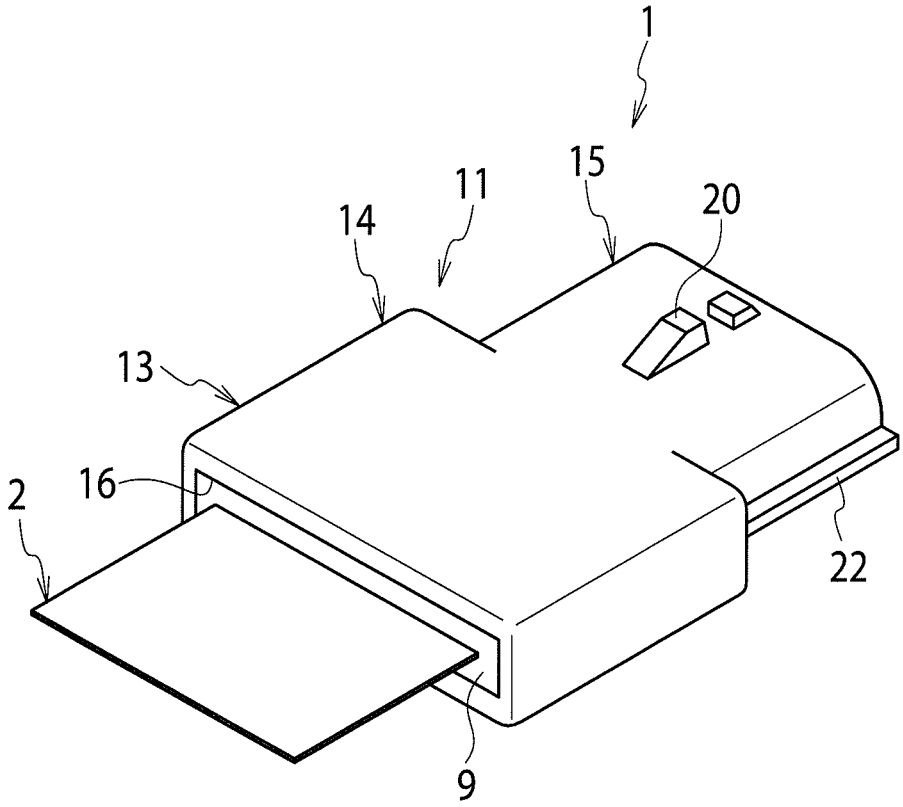
FIG. 5 is a perspective view showing the connector for flat cables.
Figure 6:
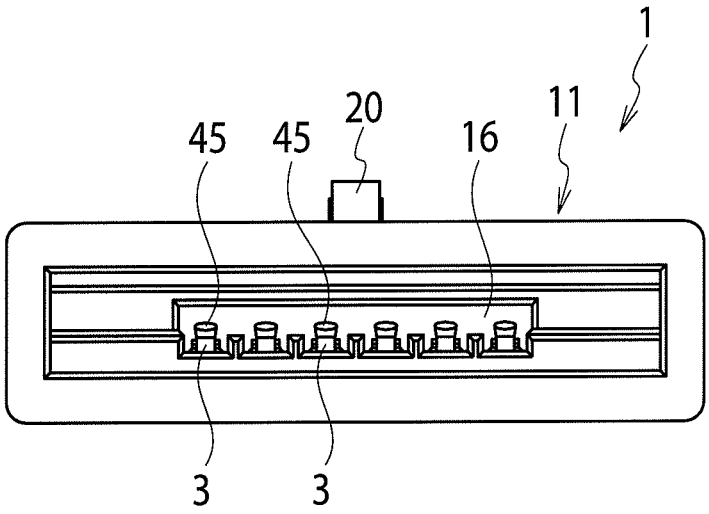
FIG. 6 is a rear view of the connector for flat cables.
Figure 7:
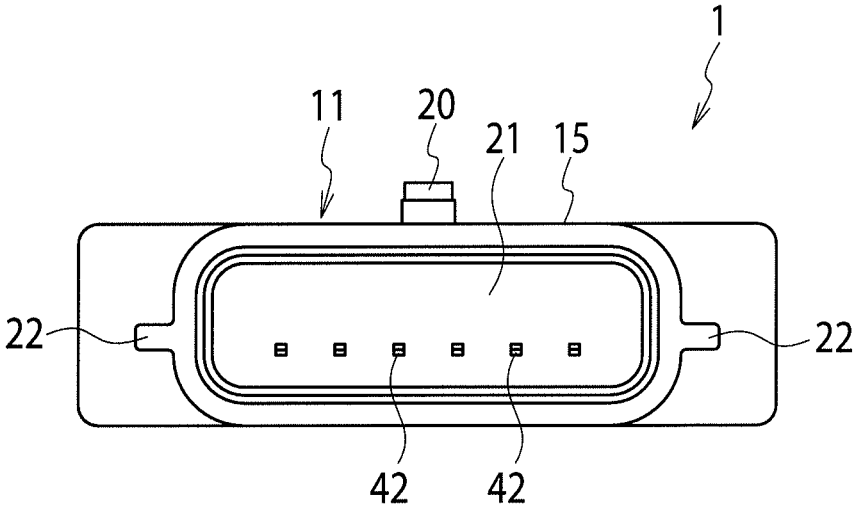
FIG. 7 is a front view of the connector for flat cables.
Figure 8:
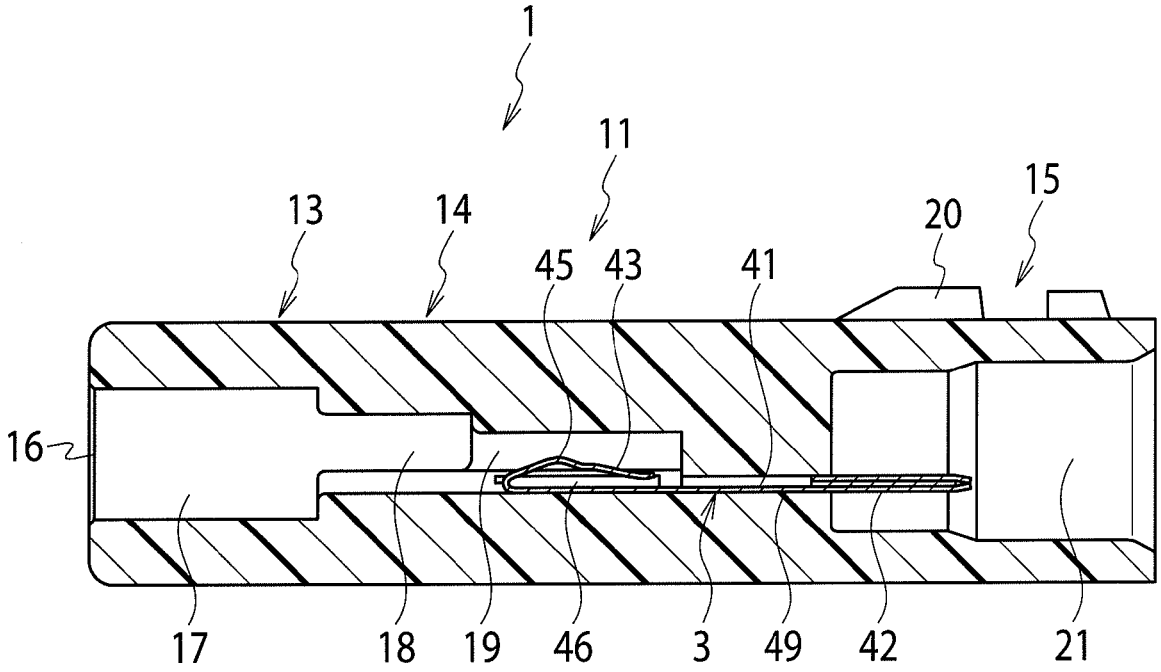
FIG. 8 is a cross sectional view along VIII-VIII line in FIG. 4, showing the inside of the connector for flat cables.
Figure 9:
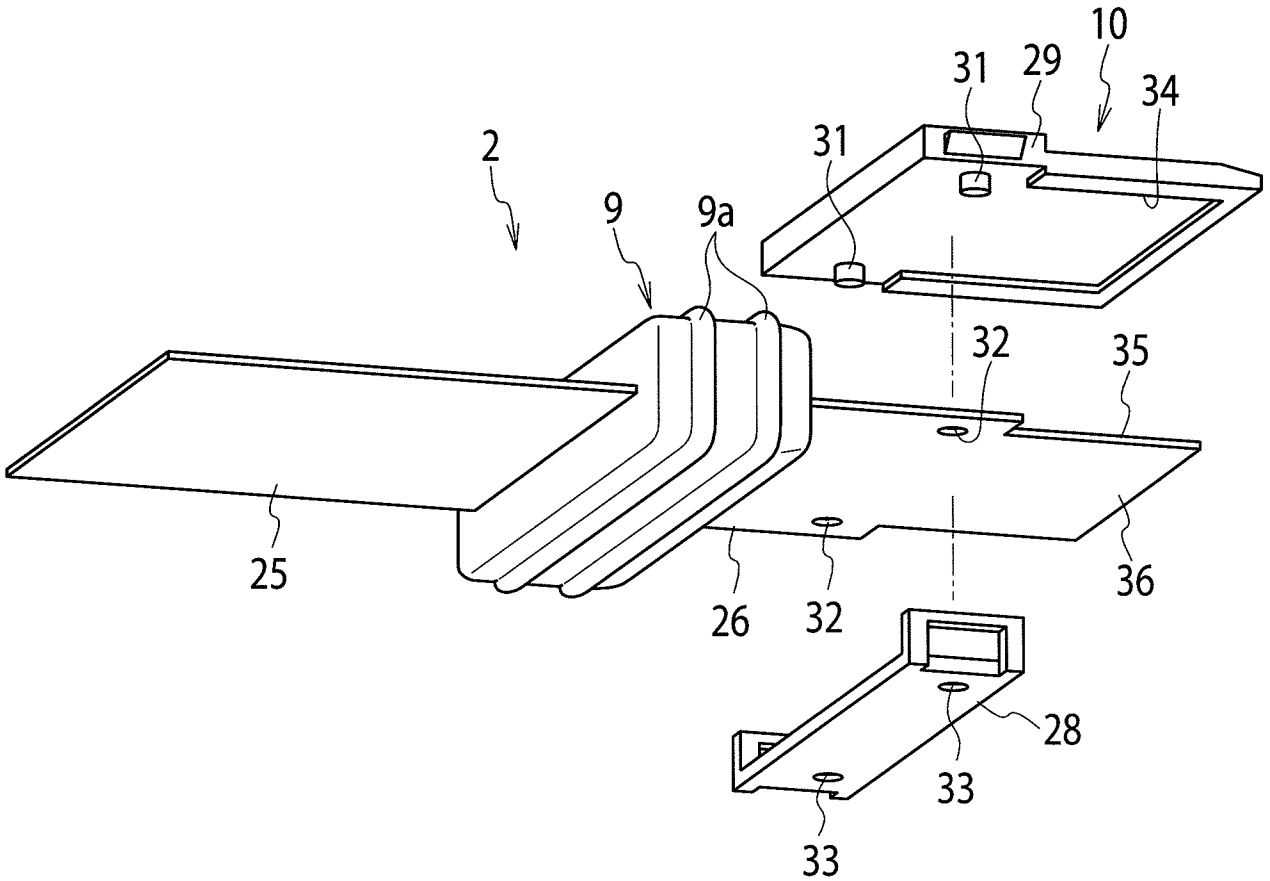
FIG. 9 is an exploded perspective view showing the flat cable.
Figure 10:
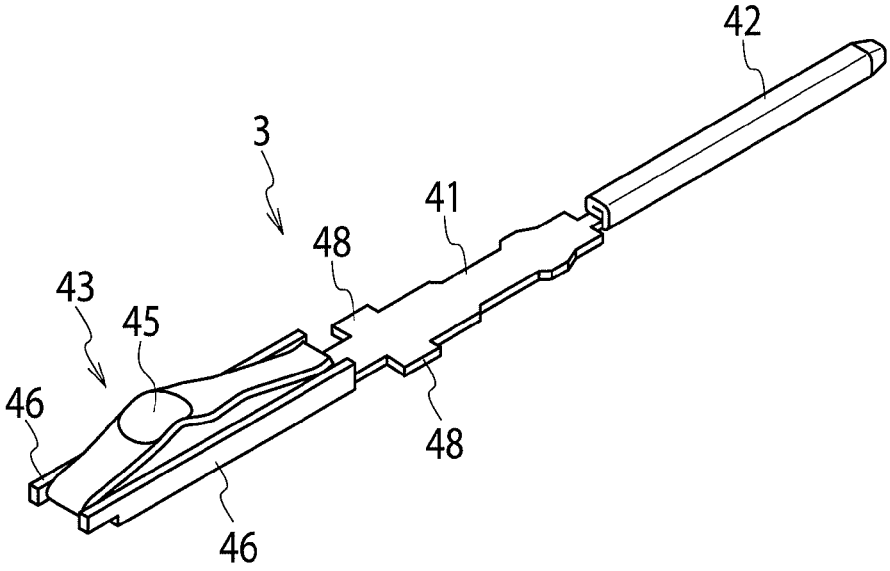
FIG. 10 is a perspective view of a relay terminal incorporated into the connector for flat cables.
Figure 11:
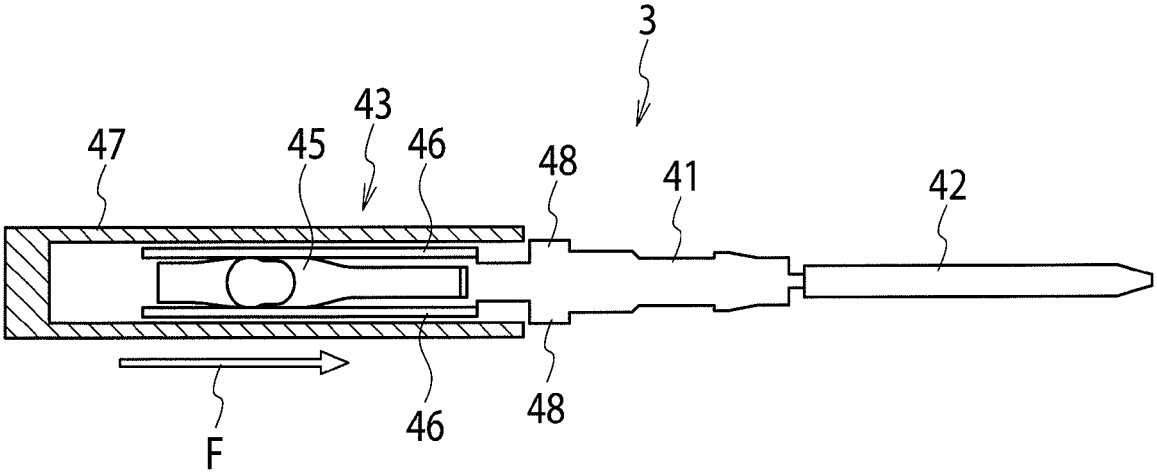
FIG. 11 is a side view of the relay terminal.
Figure 12:
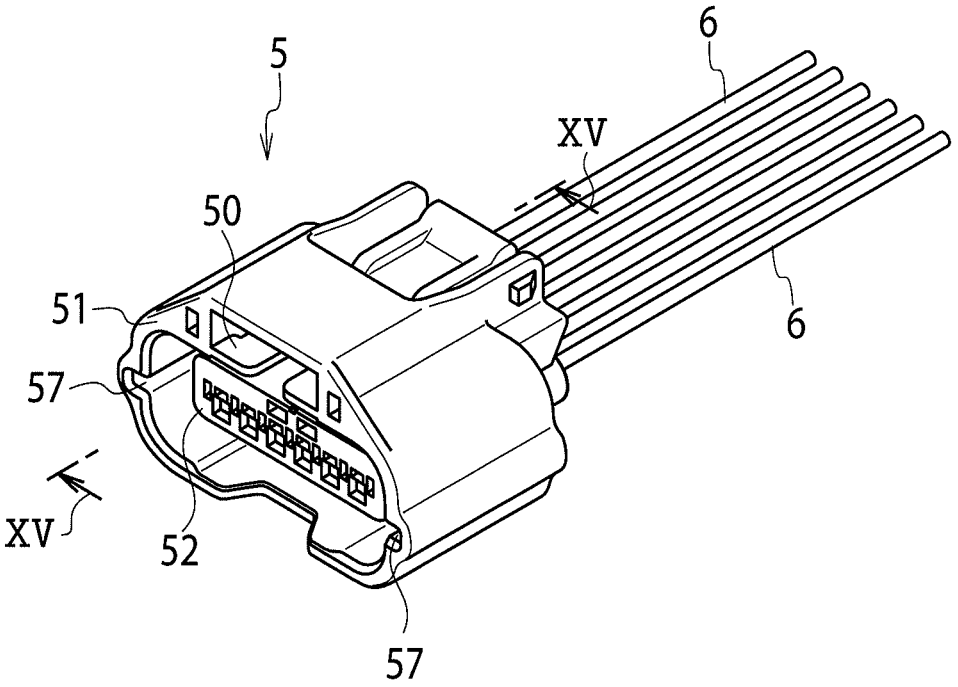
FIG. 12 is a perspective view of a mating connector to which the connector for flat cables is connected.
Figure 13:
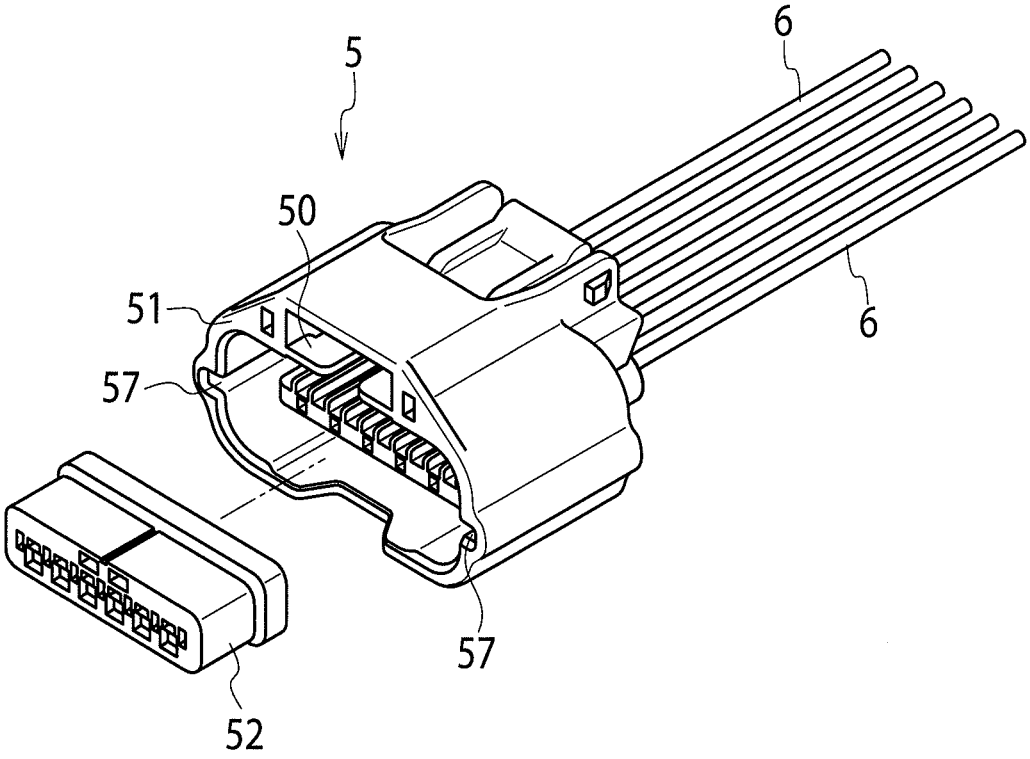
FIG. 13 is an exploded perspective view of the mating connector.
Figure 14:
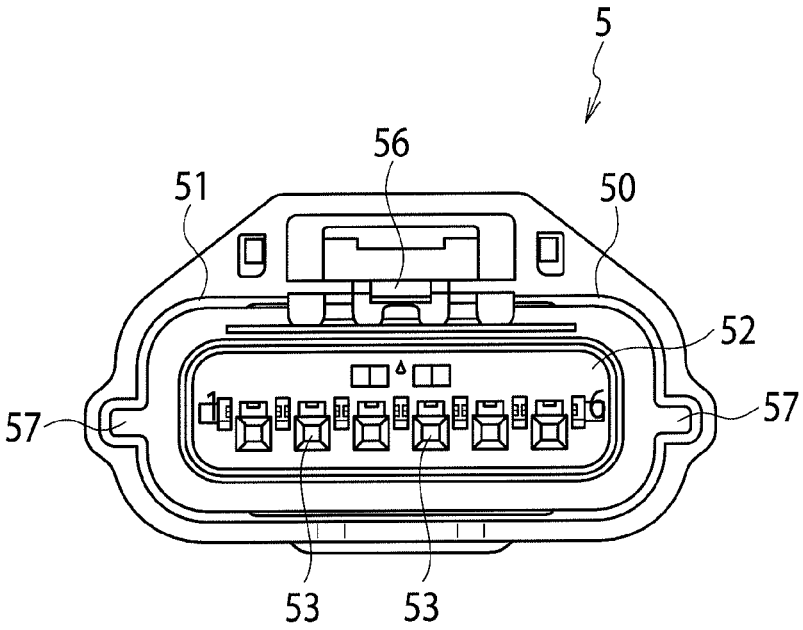
FIG. 14 is a front view of the mating connector.
Figure 15:
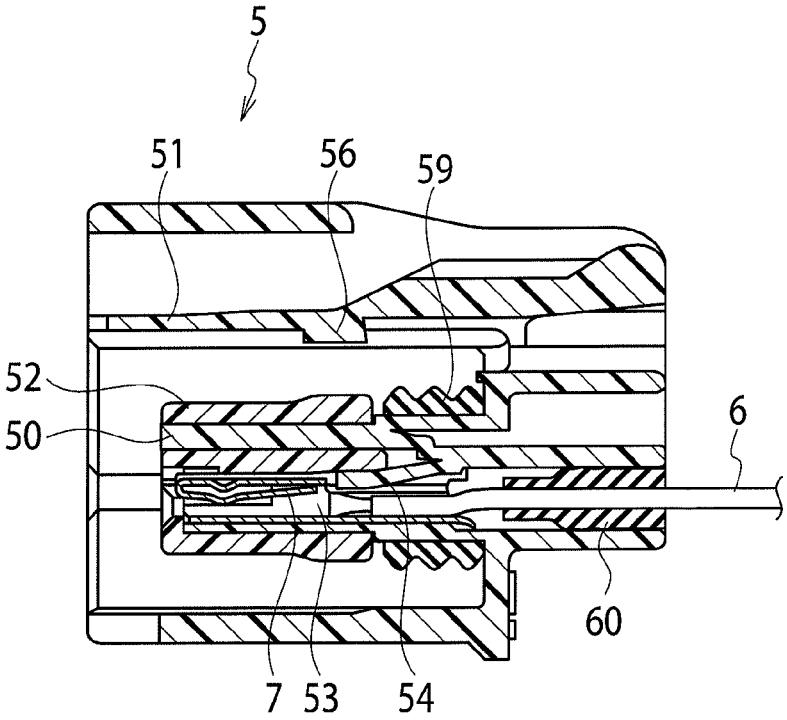
FIG. 15 is a cross sectional view along XV-XV line in FIG. 12, showing the inside of the mating connector.
Figure 16:
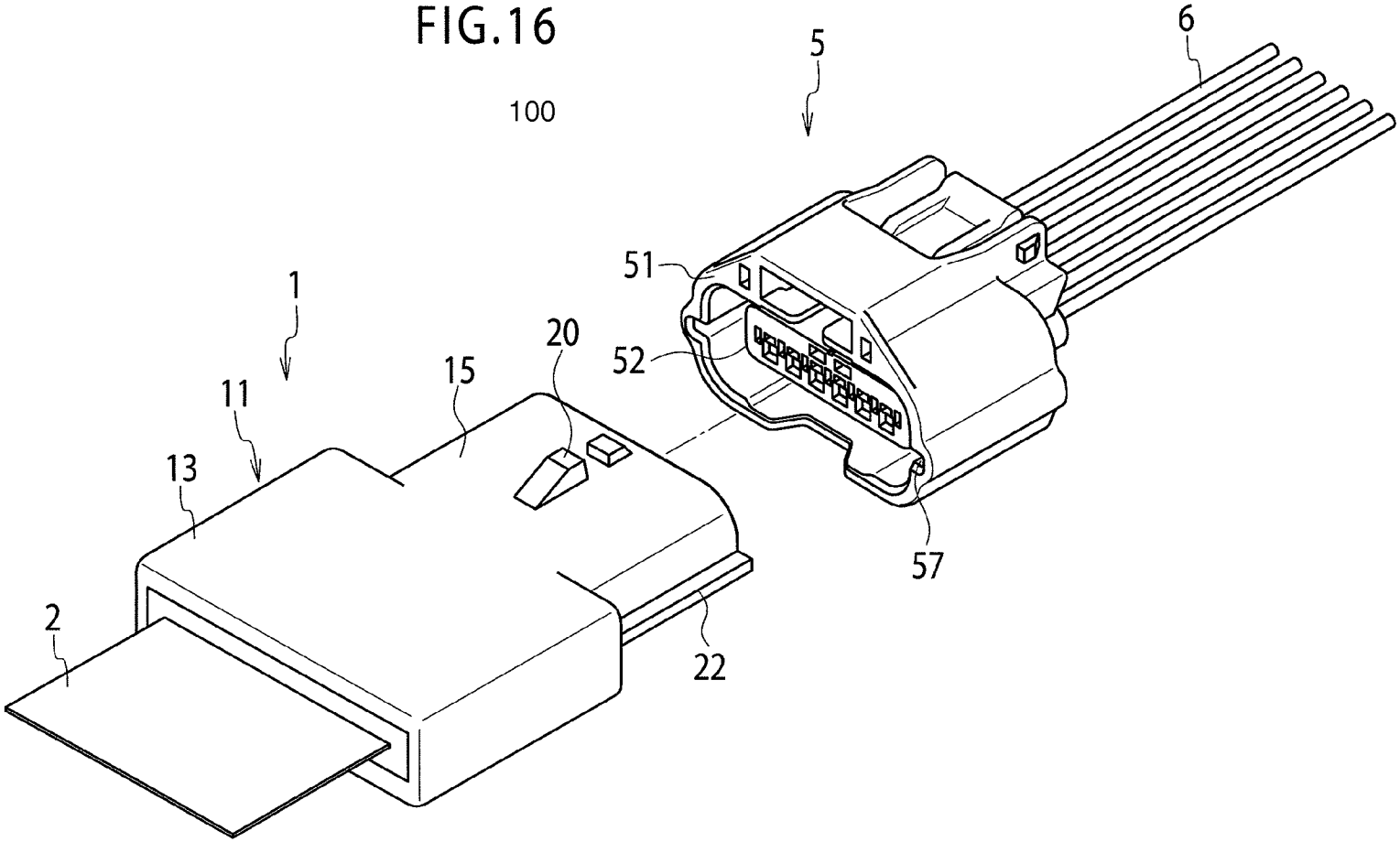
FIG. 16 is a perspective view showing the connector for flat cables and the mating connector.
Figure 17:
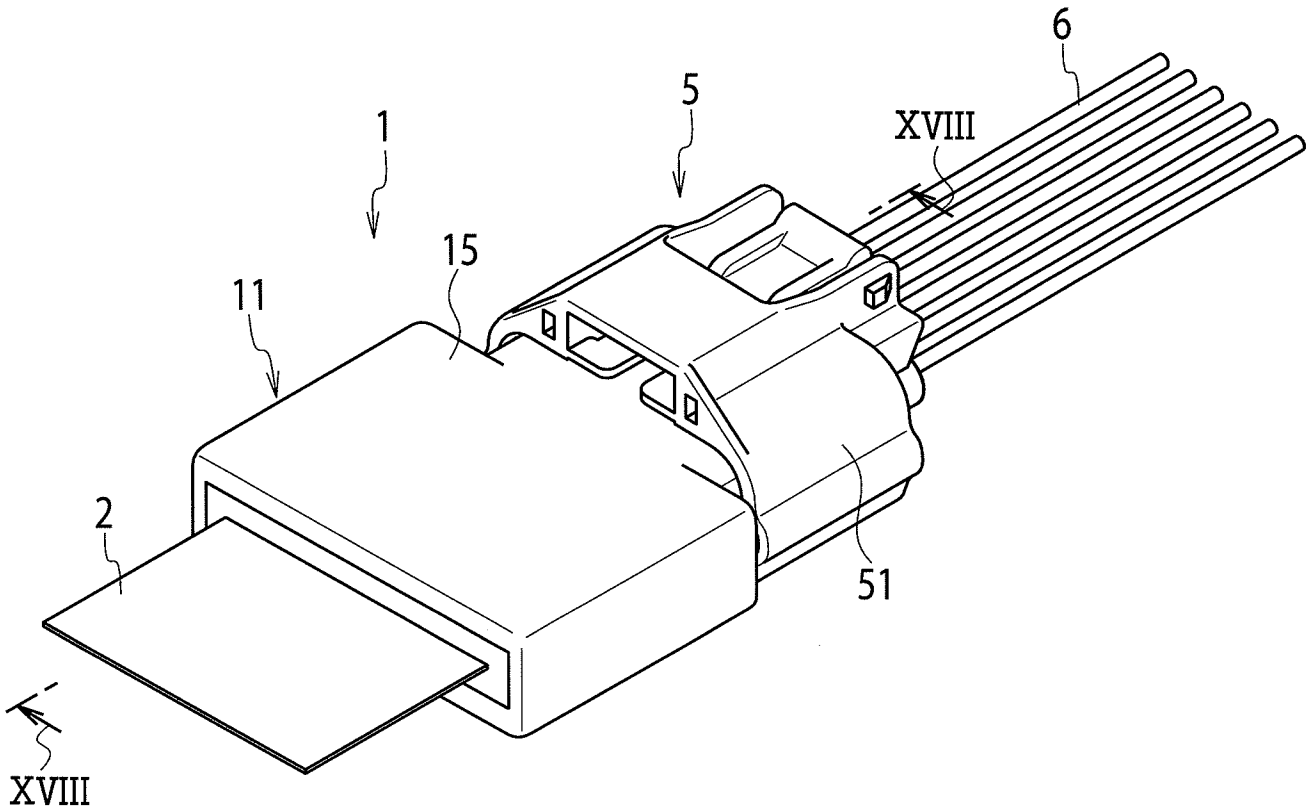
FIG. 17 is a perspective view in a state where the connector for flat cables and the mating connector are interlocked.
Figure 18:
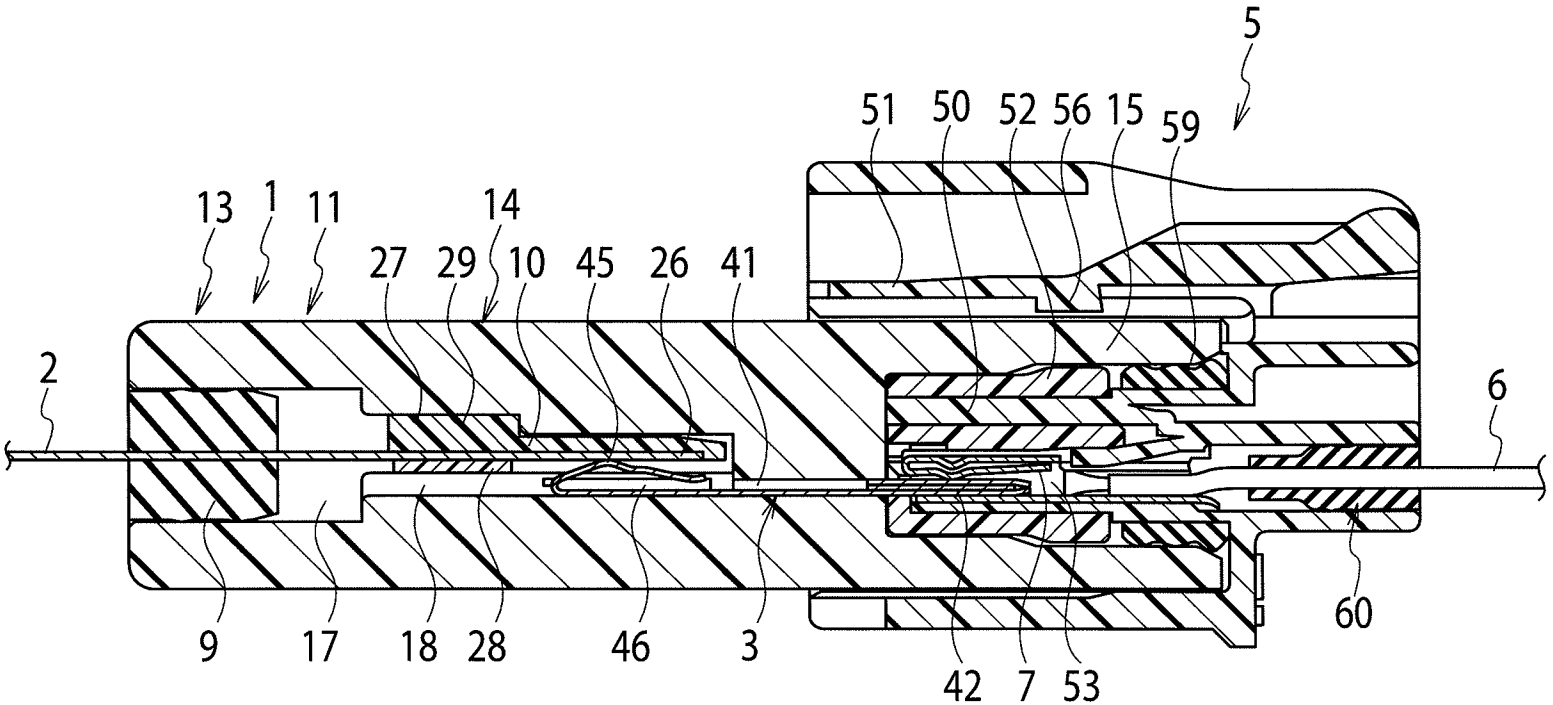
FIG. 18 is a cross sectional view along XVIII-XVIII line in FIG. 17, showing the interlocking state between the connector for flat cables and the mating connector.

FIGS. 4 to 8 show a connector for flat cables 1 of an embodiment of the present invention, wherein FIG. 4 is a perspective view showing a relationship between the connector for flat cables 1 and a flat cable 2, FIG. 5 is a perspective view of the connector for flat cables 1, FIG. 6 is a rear view, FIG. 7 is a front view, and FIG. 8 is a cross sectional view along VIII-VIII line in FIG. 4. FIG. 9 is an exploded perspective view of the flat cable 2, FIG. 10 is a perspective view of a relay terminal 3, FIG. 11 is a side view showing a state where the flat cable 2 is attached to the connector for flat cables 1. FIG. 12 is a perspective view of a mating connector 5 with which the connector for flat cables 1 interlocks, FIG. 13 is an exploded perspective view of the mating connector 5, FIG. 14 is a front view of the mating connector 5, and FIG. 15 is a cross sectional view showing the inside of the mating connector 5. FIG. 16 is a perspective view showing a relationship between the connector for flat cables 1 and the mating connector 5, FIG. 17 is a perspective view showing an interlocking state between the connector for flat cables 1 and the mating connector 5, and FIG. 18 is a cross sectional view along XVIII-XVIII line in FIG. 17, showing the inside in the interlocking state of the connector for flat cables 1 and the mating connector 5.

The flat cable 2 and the relay terminal 3 are assembled to the connector for flat cables 1 of this embodiment and with this assembled state, the flat cable 2 and the relay terminal 3 are interlocked with the mating connector 5, and thereby a terminal fitting 7 of a terminal of an electric wire 6 incorporated into the mating connector 5 and the relay terminal 3 are connected. This results in a structure where the flat cable 2 and the electric wire 6 are connected via the relay terminal 3.

The connector for flat cables 1 includes a connector housing 11, the whole of which is formed of resin, and a plurality of relay terminals 3 attached to the inside of the connector housing 11.

As shown in FIG. 4, FIG. 5, and FIG. 8, the connector housing 11 has a flat cable terminal-section insertion section 13, a relay terminal fixing section 14, and an interlocking hood section 15 integrally formed sequentially from the insertion side (the left end side) of the flat cable 2 toward a side (right end side) interconnecting with the mating connector 5.

At a rear end portion (left end) of the flat cable terminal-section insertion section 13, a cable insertion opening 16 into which the flat cable 2 is inserted is opened. As shown in FIG. 8, in the flat cable terminal-section insertion section 13, a sealant accommodating section 17 is formed so as to interlink with the cable insertion opening 16. In the relay terminal fixing section 14 continuous with the flat cable terminal-section insertion section 13, a slider accommodating section 18 and a relay terminal accommodating section 19 are formed so as to interlink.

These accommodating sections 17, 18, and 19 include holes that are formed so as to interlink in the connector housing 11, wherein the sealant accommodating section 17 includes the most widely opened hole, the slider accommodating section 18 includes the next most widely opened hole, and the relay terminal accommodating section 19 includes the least widely opened hole. The sealant 9 attached to the flat cable 2 is accommodated in the sealant accommodating section 17 while being fitted into the sealant accommodating section 17. The slider 10 attached to the flat cable 2 is accommodated in the slider accommodating section 18, and the relay terminal 3 is accommodated in the relay terminal accommodating section 19.

The interlocking hood section 15 is formed in a tip portion (right end) of the connector housing 11 so as to have a smaller width than the flat cable terminal-section insertion section 13 and the relay terminal fixing section 14. In the interlocking hood section 15, a lock projection 20 to interlock with the mating connector 5 is formed in its outer surface (upper surface). Moreover, the interlocking hood section 15 is for a connector body 50 of the mating connector 5 described later to interlock therewith, wherein a hole-like mating connector insertion portion 21 is formed.

Furthermore, on the both sides of the interlocking hood section 15, a guide piece 22 extending in a direction to interlock with the mating connector 5 is formed. The guide piece 22 serves as a guide in interlocking the interlocking hood section 15 with the mating connector 5, and thereby the operation of interlocking the connector for flat cables 1 with the mating connector 5 can be stably performed.

As shown in FIG. 4 and FIG. 9, the flat cable 2 is formed of a flexible cable body 25 including FPC, FFC, or the like, in which a wiring pattern is formed, and the sealant 9 and the slider 10 attached to the terminal section 26 at the tip (right end) in the cable body 25. In the flat cable 2, the terminal section 26 having the sealant 9 and the slider 10 attached thereto is inserted into the flat cable terminal-section insertion section 13 in the connector housing 11 of the connector for flat cables 1.

The sealant 9 is formed of a rubber having a plurality of rib portions 9*a* formed in its circumference surface. The terminal section 26 of the cable body 25 extends through the sealant 9, and thereby the sealant 9 is attached to the terminal section 26. When the terminal section 26 of the flat cable 2 is inserted into the flat cable terminal-section insertion section 13, the sealant 9 is accommodated in the sealant accommodating section 17 and in this accommodated state the sealant 9 is in close contact with the inner peripheral surface of the sealant accommodating section 17 (see FIG. 5 and FIG. 18). Thus, a waterproof function is given to the insertion side of the flat cable 2.

The slider 10 is attached to the terminal section 26 of the cable body 25 so as to position on the tip side from the sealant 9. As shown in FIG. 9, the slider 10 is formed of a flat slider body 27 and a slider cover 28 attached to the rear side of the slider body 27. Such a slider 10 is accommodated in the slider accommodating section 18 of the connector housing 11 by inserting the flat cable 2 into the housing 11 of the connector for flat cables 1.

The slider body 27 is for covering the one surface side (upper side) 35 in the terminal section 26 of the flat cable 2, and in its lower surface is formed an accommodating recess 34 matched with the external shape of the terminal section 26 of the flat cable 2. By fitting the terminal section 26 of the flat cable 2 into the accommodating recess 34, the one surface side 35 of the terminal section 26 is covered with the slider body 27 (slider 10).

The slider body 27 has a stopper wall 29 protruding upward, and the stopper wall 29 abuts against the inner wall of the slider accommodating section 18 of the connector housing 11. By this abutting, positioning with respect to the slider accommodating section 18 of the slider 10 is performed. In the lower surface of the slider body 27, a plurality of bosses 31 is provided in a protruding manner, and the boss 31 fits into a boss hole 32 formed in the terminal section 26 of the flat cable 2, and thereby the slider body 27 is fixed, in the positioned state, to the terminal section 26 of the flat cable 2.

The slider cover 28 has the boss hole 33, into which the boss 31 of the slider body 27 is fitted, and is interconnected to the slider body 27, with the terminal section 26 of the flat cable 2 being sandwiched between the slider cover 28 and the slider body 27. The slider cover 28 is to be interconnected to the rear side (left side) of the slider body 27, wherein in the state where the slider cover 28 is attached to the slider body 27, a tip portion of the other surface side 36 of the terminal section 26 of the flat cable 2 is exposed from the slider 10. Due to the exposure of the tip portion of the other surface side of the terminal section 26, an electrode portion (not illustrated) of a wiring pattern formed in this tip portion can contact and have conduction with the relay terminal 3.

As shown in FIG. 10 and FIG. 11, the relay terminal 3 includes a terminal body 41, a male tab terminal portion 42 as a mating terminal connecting section formed in one side of the terminal body 41, and a flat cable terminal connecting section 43 integrally formed on the other side of the terminal body 41, wherein the whole thereof is formed of a conductive metal.

The male tab terminal portion 42 as the mating terminal connecting section is connected to the terminal fitting 7 accommodated in the mating connector 5 when the terminal fitting 7 elastically contacts the male tab terminal portion 42.

The flat cable terminal connecting section 43 is to be connected to the terminal section 26 of the flat cable 2 inserted in the flat cable terminal-section insertion section 13 of the connector housing 11 and is formed of a spring terminal 45, which is elastic and raised to the upper side (the terminal section 26 side), and a protection wall 46 provided on the both sides of the spring terminal 45.

The spring terminal 45 elastically contacts the other surface side 36 of the terminal section 26 of the flat cable 2 exposed from the slider cover 28, thereby contacting an electrode portion of the other surface side 36. Thus, the flat cable 2 and the relay terminal 3 are electrically connected. The protection wall 46 is raised in the same direction as that of the spring terminal 45 on the both sides of the spring terminal 45 and prevents the spring terminal 45 from being damaged.

FIG. 11 shows a state where the relay terminal 3 is inserted into the connector housing 11 of the connector for flat cables 1. The relay terminal 3 is accommodated in the relay terminal accommodating section 19 of the connector housing 11 from the cable insertion opening 16 using a terminal press-fitting jig 47. The relay terminal 3 is inserted into the relay terminal accommodating section 19 by being press-fit along the direction shown by an arrow F. The protection wall 46 is positioned on the both sides of the spring terminal 45, and prevents the spring terminal 45 from being damaged by the terminal press-fitting jig 47 during press fitting.

As shown in FIG. 10 and FIG. 11, the locking dowel 48 is formed in the terminal body 41 of the relay terminal 3. The locking dowel 48 is formed so as to protrude in the width direction from the both sides of the terminal body 41, so that the tip of the terminal press-fitting jig 47 press-fitting the relay terminal 3 into the connector housing 11 can abut against the locking dowel 48. The tip of the terminal press-fitting jig 47 abuts against the locking dowel 48 in this manner, and thereby a press-fitting force to the connector housing 11 can be applied to the relay terminal 3. Thus, the relay terminal 3 can be press-fit all the way to the relay terminal accommodating section 19 of the connector housing 11. Such a locking dowel 48 is locked against the inner wall of the relay terminal accommodating section 19 of the connector housing 11. Due to this locking, the relay terminal 3 can be reliably attached to the connector housing 11.

In this embodiment, the relay terminal fixing section 49 is formed in the relay terminal accommodating section 19 accommodating the relay terminal 3. As shown in FIG. 8, the relay terminal fixing section 49 is provided between the flat cable terminal-section insertion section 13 and the interlocking hood section 15 of the connector housing 11, and is formed of a fixing insertion-hole that interlinks the flat cable terminal-section insertion section 13 and the mating connector insertion portion 21 of the interlocking hood 15. The terminal body 41 is inserted into the relay terminal fixing section 49 including the fixing insertion-hole, and due to this insertion the relay terminal 3 is fixed to the relay terminal fixing section 49 (connector housing 11).

As shown in FIG. 12 to FIG. 15, the mating connector 5 is formed of the connector body 50, a mantle section 51 covering the connector body 50, and a front holder 52.

The connector body 50 includes a plurality of terminal accommodating chambers 53 each accommodating the terminal fitting 7 connected to the terminal of the electric wire 6. As shown in FIG. 15, a locking lance 54 is provided in each of the terminal accommodating chambers 53, wherein the locking lance 54 locks against the terminal fitting 7 inserted into the terminal accommodating chamber 53, thereby preventing the terminal fitting 7 from slipping out to the tip side thereof (the right end side).

The front holder 52 is attached to the outer periphery of the connector body 50 by the connector body 50 being inserted thereinto. The front holder 52 is attached to the outer periphery of the connector body 50, and thereby the front holder 52 prevents the terminal fitting 7 from slipping out of the terminal accommodating chamber 53.

The mantle section 51 covers the connector body 50 on the outside of the connector body 50, wherein the interlocking hood section 15 of the connector for flat cables 1 is inserted between the mantle section 51 and the connector body 50. In the mantle section 51, a lock section 56 to engage with the lock projection 20, which is formed in the interlocking hood section 15 on the connector for flat cables 1 side, is formed (see FIG. 14 and FIG. 15). Moreover, a guide groove 57, along which the guide piece 22 of the interlocking hood section 15 slides, is formed in the inner wall of the mantle section 51.

In addition to the above, a rubber gasket 59 is provided in the mating connector 5. As shown in FIG. 15 and FIG. 18, the rubber gasket 59 is to be fit into the connector body 50 so as to cover the whole circumference surface of the connector body 50. Moreover, the rubber gasket 59 is arranged so as to be positioned on the tip side (the right end side) from the front holder 52, and is retained by the front holder 52.

As shown in FIG. 18, the interlocking hood section 15 of the connector for flat cables 1 is inserted into the mantle section 51 of the mating connector 5, and thereby the rubber gasket 59 blocks between the circumference surface of the connector body 50 and the inner wall of the interlocking hood section 15. Thus, waterproof between the connector for flat cables 1 (interlocking hood section 15) and the mating connector 5 (connector body 50) can be achieved.

Furthermore, a waterproof plug 60 including rubber is attached to each electric wire 6. The waterproof plug 60 is attached to the terminal of each electric wire 6, and the terminal fitting 7 is inserted into the terminal accommodating chamber 53, thereby blocking between the inner wall of the terminal accommodating chamber 53 and the circumference surface of the electric wire 6. Thus, waterproof between the mating connector 5 (terminal accommodating chamber 53) and the electric wire 6 can be achieved.

In this embodiment, the relay terminal 3 is accommodated in the connector housing 11 of the connector for flat cables 1. The relay terminal 3 is accommodated in the relay terminal accommodating section 19 of the connector housing 11. Then, the terminal body 41 of the relay terminal 3 is fixed to the relay terminal fixing section 49, resulting in a state where the male tab terminal portion 42 protrudes into the mating connector insertion portion 21 of the connector housing 11 (see FIG. 8).

Next, the flat cable 2 is inserted into the connector housing 11 from the cable insertion opening 16. The terminal section 26 of the flat cable 2 has the slider 10 attached thereto, and the insertion of the flat cable 2 is completed by the slider 10 being inserted into the slider accommodating section 18. The spring terminal 45 of each relay terminal 3 elastically contacts the electrode portion of the other surface side 36 in the terminal of the inserted flat cable 2, and through this contact the flat cable 2 and the relay terminal 3 are electrically connected.

Through insertion of such a flat cable 2 into the connector housing 11, the sealant 9 attached to the flat cable 2 closely contacts the inner wall of the sealant accommodating section 17 of the connector housing 11, and therefore a waterproof function can be given to the insertion portion of the flat cable 2.

Next, with respect to the mating connector 5 in the state where the terminal fitting 7 of the terminal of the electric wire 6 is accommodated in the terminal accommodating chamber 53, the interlocking hood section 15 is inserted into the mantle section 51, thereby attaching the connector for flat cables 1 to the mating connector 5. Through this insertion, the terminal fitting 7 inside the terminal accommodating chamber 53 elastically contacts the male tab terminal portion 42 in the relay terminal 3 on the connector for flat cables 1 side. Then, through this contact, the terminal fitting 7 (electric wire 6) and the flat cable 2 can be electrically connected via the relay terminal 3.

According to the above embodiment, the sealant 9 is applied to the terminal section 26 of the flat cable 2, and the flat cable 2 is inserted into the connector housing 11 of the connector for flat cables 1, and thereby the sealant 9 is accommodated in the sealant accommodating section 18 of the connector housing 11 and a waterproof function can be given to the insertion portion of the flat cable 2.

Moreover, the slider 10 is attached to the terminal section 26 of the flat cable 2, and with the slider 10 the flat cable 2 can be connected to the relay terminal 3 and the connection between the flat cable 2 and the relay terminal 3 can be reliably made.

Moreover, when the relay terminal 3 is accommodated in the connector housing 11, the mating terminal connecting section 42 of the relay terminal 3 contacts the terminal fitting 7 of the mating connector 5, and thereby the flat cable 2 and the terminal fitting 7 of the mating connector 5 can be electrically connected.

Moreover, because the locking dowel 48 of the relay terminal 3 is locked against the inner wall of the connector housing 11, the relay terminal 3 can be reliably attached to the connector housing 11, and furthermore because the spring terminal 45 of the relay terminal 3 elastically contacts the terminal section 26 of the flat cable 2, the connection between the relay terminal 3 and the flat cable can be reliably made. Furthermore, because the protection wall 46 is formed on the both sides of the spring terminal 45, the spring terminal 45 can be protected in inserting the relay terminal 3 into the connector housing 11.

Moreover, because the sealant accommodating section 17, the relay terminal accommodating section 19, and the slider accommodating section 18 are formed in the flat cable terminal-section insertion section 13 of the flat cable 2, the sealant 9, the relay terminal 3, and the slider 10 of the flat cable 2 can be reliably accommodated. Furthermore, because the fixing insertion-hole 49 fixing the relay terminal 3 is formed in the connector housing 11, the relay terminal 3 can be easily accommodated in the connector housing 11.

Moreover, by interlocking the interlocking hood section 15 with respect to the mantle section 51 of the mating connector 5, the mating connector 5 and the connector for flat cables 1 can be connected.

Note that, Japanese Patent Application No. 2010-182112 (filed on Aug. 17, 2010) is hereby incorporated by reference herein in its entirety.

The present invention is not limited to the description of the above embodiment of the invention, and can be implemented in various other forms by making suitable modifications.

The invention claimed is:

1. A connector for a flat cable comprising:

a connector housing, on one side of which is formed a flat cable terminal-section insertion section wherein a flat cable terminal section is inserted, and on the other side of which is formed an interlocking hood section wherein a mating connector of an electric wire terminal connects to the flat cable;

a relay terminal which is accommodated inside the connector housing, one end of which is connected to the flat cable terminal section, the other end of which is connected to a terminal fitting of the electric wire terminal accommodated in the mating connector, and connects the flat cable and an electric wire connected to the electric wire terminal; and a sealant accommodating section, wherein a sealant which is attached to the flat cable terminal section is accommodated, is provided in the flat cable terminal-section insertion section, wherein the flat cable terminal section includes a flat cable end and a slider which is attached to a tip side of the flat cable end and connects the flat cable to one end of the relay terminal; and wherein the sealant is attached to the flat cable end.

2. The connector for a flat cable according to claim 1, wherein the slider is formed of a slider body covering one surface side of the flat cable end and a slider cover covering the other surface side of the flat cable end with the tip portion thereof being exposed.

3. The connector for a flat cable according to claim 2, wherein the relay terminal is formed of:

a terminal body;

a mating terminal connecting section which is provided on one side of this terminal body, provided in a protruding manner in the interlocking hood section in a state of being accommodated in the connector housing, and connects to the terminal fitting accommodated in the mating connector; and a flat cable terminal connecting section provided on the other side of the terminal body and connected to the flat cable terminal section.

4. The connector for a flat cable according to claim 3, wherein a locking dowel locking against an inner wall of a relay terminal accommodating section of the connector housing is formed on both sides of the terminal body; and wherein a spring terminal in contact with the flat cable end and a protection wall which is provided on both sides of this spring terminal and protects the spring terminal, are formed in the flat cable terminal connecting section.

5. The connector for a flat cable according to claim 4, wherein the sealant accommodating section, a relay terminal accommodating section, wherein a connection side of the flat cable end of the relay terminal is accommodated, and a slider accommodating section, wherein the slider of the flat cable terminal section is accommodated, are provided in the flat cable terminal-section insertion section; wherein in the connector housing, a relay terminal fixing section to which the relay terminal is fixed is provided between the flat cable terminal-section insertion section and the interlocking hood section; and wherein the relay terminal fixing section is a fixing insertion-hole that interlinks an interlocking hood section side and a flat cable terminal-section insertion section side.

6. The connector for a flat cable according to claim 5, wherein the mating connector is formed of:

a connector body with a terminal accommodating chamber, in which the terminal fitting connected to the other end of the relay terminal is accommodated, a mantle section which covers the connector body and into which the interlocking hood section of the connector housing is inserted; and a front holder preventing the terminal fitting, which is accommodated in the connector body and connected to the other end of the relay terminal, from slipping out of the terminal accommodating chamber, and wherein with the mating connector being interlocked with the interlocking hood section of the connector housing, a rubber gasket is arranged between a circumference surface of the connector body and the inner wall of the interlocking hood section.

* * * * *